US005221458A

United States Patent [19]

Herbert et al.

[11] Patent Number: 5,221,458

[45] Date of Patent: Jun. 22, 1993

[54] ELECTROFORMING PROCESS FOR ENDLESS METAL BELT ASSEMBLY WITH BELTS THAT ARE INCREASINGLY COMPRESSIVELY STRESSED

[75] Inventors: William G. Herbert; Mark S. Thomas, both of Williamson, N.Y.

[73] Assignee: Xerox Corporation, Stamford, Conn.

[21] Appl. No.: 632,518

[22] Filed: Dec. 24, 1990

[51] Int. Cl.[5] ..... C25D 1/04

[52] U.S. Cl. ..... 205/67

[58] Field of Search ..... 204/3, 4, 9

[56] References Cited

U.S. PATENT DOCUMENTS

| | | | |
|---|---|---|---|
| 3,604,283 | 9/1971 | Van Doorne | 474/8 |
| 3,799,859 | 3/1974 | Wallin | 204/216 |
| 3,844,906 | 11/1974 | Bailey et al. | 204/9 |
| 3,959,109 | 5/1976 | Hambling et al. | 204/212 |
| 3,970,527 | 7/1976 | Brown | 204/9 |
| 4,067,782 | 1/1978 | Bailey et al. | 204/25 |
| 4,501,646 | 2/1985 | Herbert | 204/4 |
| 4,530,739 | 7/1985 | Hanak et al. | 204/4 |
| 4,579,549 | 4/1986 | Okawa | 474/242 |
| 4,650,442 | 3/1987 | Parsons | 474/29 |
| 4,661,089 | 4/1987 | Cuypers | 474/242 |
| 4,664,758 | 5/1987 | Grey | 204/3 |
| 4,787,961 | 11/1988 | Rush | 204/9 |
| 4,902,386 | 2/1990 | Herbert et al. | 204/9 |

OTHER PUBLICATIONS

Keeton, C. R., *Metals Handbook*, 9th Edition, "Ring Rolling", pp. 108–127.

*Primary Examiner*—T. M. Tufariello

*Attorney, Agent, or Firm*—Oliff & Berridge

[57] ABSTRACT

An electroforming process for forming a multilayer endless metal belt includes forming increasingly compressively stressed successive layers on a mandrel, and assembling the layers to form a multilayer belt. The belt is particularly useful as a driving member for a continuously-variable transmission.

30 Claims, 1 Drawing Sheet

PLOT OF TEMPERATURE VERUS COMPRESSIVE STRESS

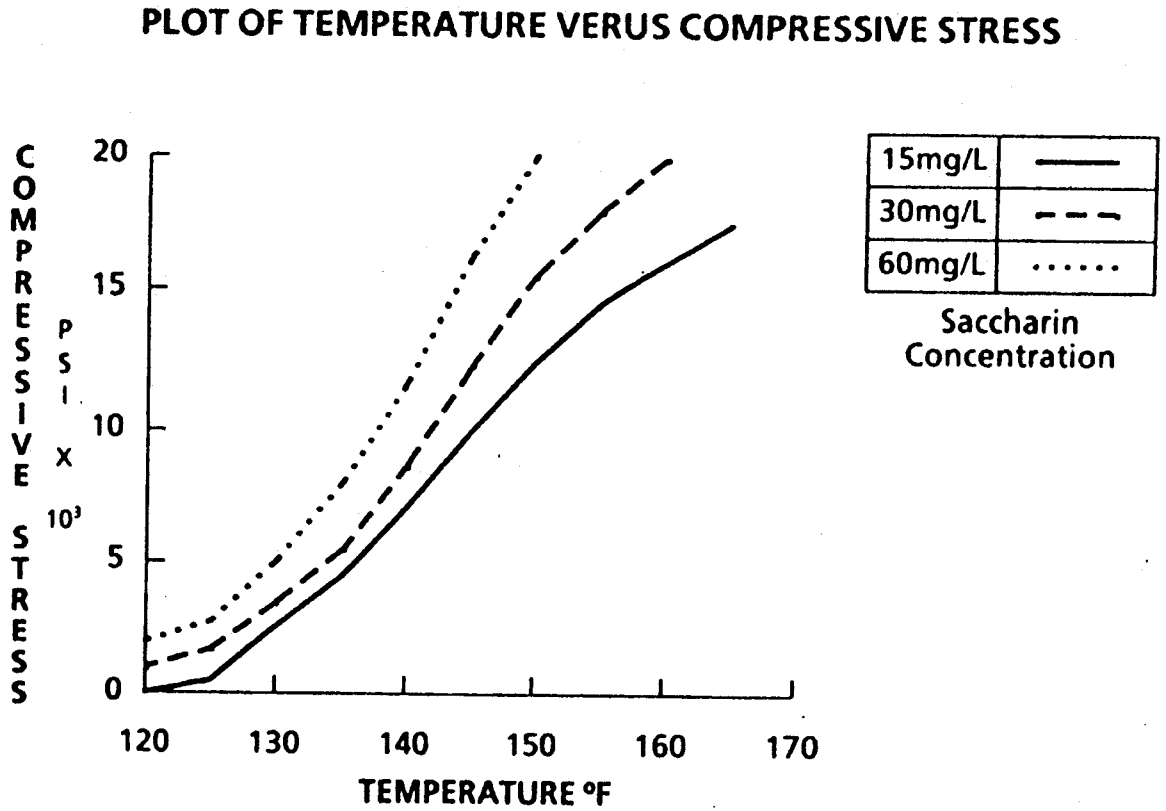
FIGURE

ELECTROFORMING PROCESS FOR ENDLESS METAL BELT ASSEMBLY WITH BELTS THAT ARE INCREASINGLY COMPRESSIVELY STRESSED

BACKGROUND OF THE INVENTION

This invention relates in general to electroformed belts, and in particular, to a process for electroforming metal belts.

Electroforming has been known for many years as a method for producing metal objects by passing an electric current through an electrolyte solution in which are immersed an anode and a cathode, in order to deposit a metal in the electrolyte solution onto either the anode or the cathode, thus forming an object.

U.S. Pat. No. 3,844,906 to Bailey et al. discloses a process for maintaining a continuous and stable aqueous nickel sulfamate electroforming solution adapted to form a relatively thin, ductile, seamless nickel belt. Nickel is electrolytically deposited from the solution onto a support mandrel. A nickel belt is recovered by cooling the nickel coated mandrel, effecting a parting of the nickel belt from the mandrel due to the different respective coefficients of thermal expansion. The process comprises establishing an electroforming zone comprising a nickel anode and a cathode comprising the support mandrel, the anode and cathode being separated by the nickel sulfamate solution maintained at a temperature of about 140° to 160° F. and having a current density therein ranging from about 200 to about 500 amps/ft$^2$; imparting sufficient agitation to the solution to continuously expose the cathode to fresh solution; maintaining the solution within the electroforming zone at a stable equilibrium composition comprising nickel, halide and boric acid; electrolytically removing metallic and organic impurities from the solution upon removal from the electroforming zone; continuously charging to the solution about 1.0 to $2.0\times10^{-4}$ moles of a stress reducing agent per mole of nickel electrolytically deposited from the solution; passing the solution through a filtering zone to remove any solid impurities therefrom; cooling the solution sufficiently to maintain the temperature within the electroforming zone upon recycle thereto to about 140° to 160° F. at the current density in the electroforming zone; and recycling the solution to the electroforming zone.

U.S. Pat. No. 4,501,646 to Herbert discloses an electroforming process for forming hollow articles having a small cross-sectional area. In this patent, the electroforming process employs a cathode for the core mandrel having an electrically conductive, adhesive outer surface, an anode, and an electrolyte bath comprising a salt solution of the metals used for the electrodes. This patent discloses a belt having a thickness of at least about 30 Å and stress-strain hysteresis of at least about 0.00015 in./in., and wherein a stress of between about 40,000 psi and about 80,000 psi is imparted to the cooled coating to permanently deform the coating and to render the length of the inner perimeter of the coating incapable of contracting to less than 0.04% greater than the length of the outer perimeter of the core mandrel after cooling. Any suitable metal capable of being deposited by electroforming and having a coefficient of expansion between about $6\times10^{-6}$ to $10\times10^{-6}$ in./in./°F. may be used in the process. The '646 patent describes the use of this process for forming electrically conductive, flexible, seamless belts for use in an electrostatographic apparatus wherein the belt is fabricated by electrodepositing a metal onto a cylindrically shaped mandrel which is suspended in the electrolytic bath.

U.S. Pat. No. 4,664,758 to Grey discloses an electroforming process wherein, prior to electroforming, a uniform coating of an electrically conductive metal or metal alloy is applied to the core, the metal or metal alloy coating having a melting point and a surface tension less than the melting point and surface tension of the mandrel core. The coated mandrel core is immersed in an electroforming bath, and an electroformed metal belt having a melting point greater than the coating is deposited on the coating. The electroformed metal belt is removed from the mandrel core by heating the electroformed metal belt and/or the mandrel core to a temperature which is sufficient to melt the metal or metal alloy coating but insufficient to melt the electroformed metal belt and mandrel core. This permits the mandrel to be reused. This method also provides precise control of the electroformed coatings, by compensating for surface defects in the mandrel with the initial coating.

U.S. Pat. No. 4,787,961 to Rush discloses the use of an electroforming process for preparing a multilayered metal belt, wherein a tensile band set is formed from a plurality of separate looped endless bands in a nested and superimposed relation. The patent states that the bands are free to move relative to each other even though the spacing between adjacent bands is relatively small. These bands are formed in an apparatus comprising two rigid metallic anode plates and a cylindrical mandrel cathode. By rotating the mandrel by a motor and at the same time interconnecting the cathode and anodes to an electrical power supply, a certain amount of the material in the electrolyte bath is plated onto the surface to form a continuous or endless annular band which is readily removable from the surface and which comprises the innermost band of the band set. The electroforming process described in this patent forms a multilayered belt assembly by removing each belt from the electrolyte bath in order to coat it with a material to keep the belts from adhering to one another. Another belt is then formed around the previous belt. This requires many steps before achieving the final multilayered product.

Endless metal belts have been taught in the prior art for many purposes, including use with continuously variable transmissions.

U.S. Pat. No. 3,604,283 to Van Doorne discloses a continuously-variable transmission containing a driving mechanism which comprises a driving pulley with a V-shaped circumferential groove, a driven pulley with a V-shaped circumferential groove, and a flexible endless member having chamfered (beveled) flanks interconnecting and spanning the pulleys. The diameters of the pulleys automatically and steplessly can be varied with regard to each other in such a way that different transmission ratios can be obtained. The driving member described therein is a flexible endless member consisting of one or more layers of steel belts.

U.S. Pat. No. 4,661,089 to Cuypers discloses an endless metal belt for use with a continuously variable transmission which can be subjected to greater strains and which have a long service life. This patent describes an endless metal belt wherein the tensile stresses during operation are decreased by compressive stresses at the belt's edge zone. Permanent compressive stresses are incorporated in the belt's edge zones by shot peening or rolling. When such stresses are reduced, in particular by the tensile stresses caused by bending, the strain on the belts is not so great, and thus the likelihood of belt braking caused by hairline cracks occurring from the edges is decreased.

A continuously-variable transmission belt assembly ideally is comprised of a nest of several independent belts, designed in such a way that each belt has an outside diameter which is slightly less than the inside diameter of the next larger belt in the nest. This design permits the belts to share the load. However, it has not yet been disclosed how to produce a multilayer endless metal belt assembly with the necessary thin multiple belts that can be formed to the exacting tolerances required of a continuously-variable transmission belt and which are also capable of equal load sharing. In view of the great demand and many uses for endless metal belts, it is very desirable to find a less costly method of manufacturing these belts in such a manner that they will have the exacting tolerances needed.

SUMMARY OF THE INVENTION

It is an object of the invention to provide an improved electroforming process wherein multiple belts of an endless metal belt assembly are formed wherein each belt shares an equal load.

It is an object of the invention to provide an endless metal belt assembly containing multiple belts wherein an optimal uniform gap is formed between each successive belt.

The present invention overcomes the problems of the prior art by providing an improved electroforming process and multilayer endless metal belt assembly wherein successive belts are formed with increasing compressive stress, thereby creating a controlled gap between each of the belts forming the belt assembly. The electroforming process is manipulated in order that, as the diameters of the belts increase, the compressive stress of each belt also increases.

BRIEF DESCRIPTION OF THE DRAWING

The FIGURE is a graph of temperature versus compressive stress under the conditions of Example 1.

DETAILED DESCRIPTION OF PREFERRED EMBODIMENTS

This invention provides a multilayer endless metal belt assembly with controlled gaps between each belt of the endless metal belt assembly. This invention also provides for an improved process for forming such a multilayer endless metal belt assembly.

A multilayer endless metal belt assembly is comprised of a "nest" of two or more belts in which each successive belt is superimposed on the previous belt and is slightly larger in diameter than the previous belt. This manner of construction is important because it permits each belt of the endless metal belt assembly to move independently of the other belts. This permits each belt to share its load separately, but with the overall result that the multiple belt assembly can share a greater load than one single belt of the same diameter.

Every electroformed article has internal stress characteristics. The internal stress of an electroformed article includes tensile stress and compressive stress. In tensile stress, the material has a propensity to become smaller than its current size. This is believed to be due to the existence of many voids in the metal lattice of the electroformed deposit with a tendency of the deposited material to contract to fill the voids. If there are many extra atoms in the metal lattice instead of voids there is a tendency for the electroformed material to expand and occupy a larger space. This creates compressive stress. Thus, each belt of a multilayer electroformed endless metal belt assembly will have its own characteristic tensile stress or compressive stress.

The structural causes of stresses which are internal to the composition of an electroformed article are related to departures from the crystalline arrangement of the grains (e.g., the crystals which touch each other in a continuous fashion to make up a metallic body), or other defects present within a grain. For example, the coalescence of grains or parts of grains growing laterally from different nucleation centers may be a cause. Also, the stress fields around oriented arrays of dislocations (e.g., where the density of an electrodeposit approaches that of a heavily plastically deformed metal) produced by the coalescence or other growth processes of the grains can accumulate to produce such a stress.

The multilayer endless metal belt assembly of this invention is comprised of a set of electroformed metal belts of increasing diameter. The electroforming process is manipulated to produce electroformed belts that are increasingly compressively stressed. The number of belts comprising the belt assembly may be from 2 to 40 or more. In their final configuration, the belts are superimposed and function as a single unit when used as a driving member for a continuously-variable transmission.

Lubrication is important when belts are superimposed in a nested configuration. A preferred electroforming process forms the belts with surfaces designed to trap and circulate lubricant with protuberances, indentations, and pits formed by adjusting parameters of the electroforming bath such as the mandrel surface roughness, metal ion concentration, rate of current application, current density and operating temperature of the electrolyte. The protuberances thus formed, for example, may be up to about 95% of the gap size. Electroformed belts with such surfaces are disclosed in detail in copending application Ser. No. 07/633,604 filed simultaneously herewith and entitled "Endless Metal Belt Assembly with Minimized Contact Friction", which is hereby incorporated by reference.

To increase lubricity between adjacent belts, the belts may be further improved by electroforming them so that adjacent and opposing belt surfaces are constructed of materials of different hardness, such as nickel and chromium, as disclosed in detail in copending application Ser. No. 07/633,025 filed simultaneously herewith and entitled "Endless Metal Belt with Hardened Belt Surfaces", which is hereby incorporated by reference.

The multilayer endless metal belt assembly of this invention may be produced by employing the same mandrel for each successive belt or by using separate mandrels for one or more belts. The belts may be formed individually and removed from the mandrel as each belt is formed. The belts are then superimposed after all belts are completed. Alternatively, and preferably, the belts may be formed one belt on another, with the initial belt being formed directly on the mandrel in an electroforming bath, and a second belt being formed on this first belt in an electroforming bath which differs from the first bath by having parameters which will produce an electroformed metal belt that is more compressively stressed than the first belt. Additional belts are formed in a similar manner, wherein each belt is formed on the prior belt, and each electroforming bath produces an electroformed metal belt that is more compressively stressed than the previously-formed belt. The belts are preferably kept from adhering to one another by forming a passive film such as an oxide film on the outer surface of each belt before forming the next belt, as disclosed in detail in copending application Ser. No. 07/632,998 filed simultaneously herewith and entitled "Electroforming Process For Multi-Layer Endless Metal Belt Assembly," which is hereby incorporated by reference.

A preferred method for preparing the belts of this invention is by an electroforming process similar to those disclosed in U.S. Pat. No. 3,844,906 to Bailey and U.S. Pat. No. 4,501,646 to Herbert. This process provides an electroforming bath formulated to produce a thin, seamless metal belt by electrolytically depositing metal from the bath onto an electrolytically conductive core mandrel with an adhesive outer surface. While the process described below provides that the metal is deposited on the cathode, it is also possible for the metal to be deposited on the anode, and this invention includes both arrangements.

Electroformed belts may be formed individually or in a superimposed manner to form a "nested" belt assembly. When in an assembly, each belt within the assembly is separated from the adjacent belt or belts by a gap which contains a lubricant. An advantage of the electroforming process is that it enables very thin belts to be formed in a manner that controls the gap size optimally. The optimal thickness of the belt material is identified by determining the belt thickness associated with the lowest total stress (bending stress plus direct stress) on the belt in a given dual pulley system. The total stress is equal to the sum of the bending stress plus the direct stress. Bending stress is equal to $EC/\rho$, wherein E is the elasticity, C is one half the belt thickness, and $\rho$ is the radius of curvature of the smallest pulley. Direct stress is equal to $F_1/A$, wherein $F_1$ is the tight side force between the pulleys and A is the cross-sectional area of the belt. The total stress is calculated for a series of belts of different thicknesses, and the belts are formed with the thickness which has the lowest total stress value.

The optimal gap size is the minimum gap necessary to provide adequate lubrication, since a smaller gap allows the lubricant to carry more torque than does a larger gap. This size can readily be determined by those of skill in the art. The optimal lubricant is identified by determining the lubricant with the highest torque-carrying ability within its optimal gap. The torque carrying ability of a given lubricant is equal to $$T=4\mu\pi^2Nr^3l/M_r$$

wherein $\mu$ is the absolute viscosity of the lubricant, N is the rotational velocity of the smallest pulley, r is the radius of the smallest pulley, l is the width of the belt and $M_r$ is the radial clearance (gap) between adjacent belts. The torque carrying ability is calculated for a series of different lubricants and a lubricant is selected which provides the highest value. The methods of determining optimal belt thickness and lubricant are disclosed in detail in copending application Ser. No. 07/632,519 filed simultaneously herewith and entitled "Endless Metal Belt Assembly with Controlled Parameters," which is hereby incorporated by reference.

The electroforming process takes place within an electroforming zone comprised of an anode selected from a metal and alloys thereof; a cathode which is the core mandrel; and an electroforming bath comprising a salt solution of the metal or alloys thereof which constitutes the anode, and in which bath both the anode and cathode are immersed.

Any suitable metal capable of being deposited by electroforming and having a coefficient of expansion of between $6\times10^{-6}$ in./in./°F. and $10\times10^{-6}$ in./in./°F. may be used in the process of this invention. Preferably the electroformed metal has a ductility of at least about 0.5 percent elongation. Typical metals that may be electroformed include nickel, copper, cobalt, iron, gold, silver, platinum, lead, and the like and alloys thereof. Preferably, the metal has a stress-strain hysteresis of at least about 0.00015 in./in.

The core mandrel is preferably solid and of large mass to prevent cooling of the mandrel while the deposited coating is cooled. In such an embodiment, the mandrel should have high heat capacity, preferably in the range from about 3 to about 4 times the specific heat of the electroformed article material. This determines the relative amount of heat energy contained in the electroformed article compared to that in the core mandrel.

Further, the core mandrel in such an embodiment should exhibit low thermal conductivity to maximize the difference in temperature between the electroformed article and the core mandrel during rapid cooling of the electroformed article to prevent any significant cooling and contraction of the core mandrel. In addition, a large difference in temperature between the temperature of any cooling bath used during the removal process and the temperature of the coating and mandrel maximizes the permanent deformation due to the stress-strain hysteresis effect.

During the operation of the mandrel in the electroforming process, the mandrel is connected to a rotatable drive shaft driven by a motor, and is rotated in such a manner that the electroforming bath is continuously agitated. Such movement continuously mixes the electroforming bath to ensure a uniform mixture, and passes the electroforming bath continuously over the mandrel.

Typical mandrel materials include stainless steel, iron plated with chromium or nickel, nickel, titanium, aluminum plated with chromium or nickel, titanium palladium alloys, nickel-copper alloys such as Inconel 600 and Invar (available from Inco), and the like. The outer surface of the mandrel should be passive, i.e., adhesive, relative to the metal that is electrodeposited to prevent adhesion during electroforming. The cross-section of the mandrel may be of any suitable shape. The surface of the mandrel should be substantially parallel to the axis of the mandrel.

The initial electroforming bath is formed of metal ions, the concentration of which may range from trace to saturation, which ions may be in the form of an anion or cation; a solvent; a buffering agent, the concentration of which may range from 0 to saturation; an anode depolarizing agent, the concentration of which may range from 0 to saturation; and, optionally, grain refiners, levelers, catalysts, stress reducers, and surfactants, the preferred concentration ranges of which are known to those skilled in the art.

Preferably, such an electrolyte bath is comprised of 11.5 oz/gal of nickel ion in solution, 5 oz/gal of $H_3BO_3$, 1 oz/gal of $NiCl_2.6H_2O$, and 0.0007 oz/gal of sodium lauryl sulfate (±5%).

The bath and cathode are heated to a temperature sufficient to expand the cross-sectional area of the mandrel. The core mandrel is introduced into the bath, and a ramp current is applied across the cathode and the anode to electroform a coating of the metal on the core mandrel until the desired thickness and internal stress are achieved.

The chemical composition and the physical characteristics of the belt are products of the materials which form the electrolyte bath and the physical environment in which the belt is formed. Thus, both the bath chemistry and the operating parameters of the electroforming reaction are controlled to produce belts with the desired respective compressive stresses to form the series of increasing diameters. Modifications can be made by using a series of separate baths or a single bath with changes of parameters. Any electroforming bath is a medium wherein complex interactions between such elements as the temperature, electroforming metal ion concentration, agitation, current density, density of the solution, cell geometry, conductivity, rate of flow and specific heat occur when forming the metal belt. Many of these elements are also affected by the pH of the bath and the concentrations of such components as buffering agents, anode depolarizers, stress reducers, surface tension agents, and impurities.

This relationship between apparent internal stress (perhaps more accurately expressed as the apparent average internal stress) and the change in diameter of a deposit can be expressed mathematically as:

$$\text{Change in diameter} = \Delta D = \frac{SD}{E}$$

wherein D is the diameter of the electroformed belt in inches, S is the apparent internal stress of the electroformed belt in psi, and E is the Young's modulus (about 30 million psi for nickel). Note that S is negative when the stress is tensile.

The maximum diameter of the deposit obtainable by this method will be limited by the adhesion of the deposit to the mandrel and the stability of the electrolyte at elevated temperatures. Sulfamate will start to break down at about 150° F.; consequently, one would limit the amount of time that the electrolyte was kept at temperatures at or above 150° F. If the internal stress becomes too compressive, the stress will be relieved during deposition which will result in a buckled deposit. The limit, for example, for using a well scrubbed chromium surfaced mandrel is about 20,000 psi compressive.

The maximum internal compressive stress one can use without buckle varies considerably. When using a glass mandrel which has a conductive surface provided by vacuum deposited chromium, the maximum internal compressive stress must be kept below about 1,500 psi compressive. The chromium on the glass is too thin to tolerate scrubbing or other means to remove or renew the passive layer, and thus the nickel would be deposited on a well established oxide with little propensity for adhesion.

When depositing additional belts over a previous belt, the maximum internal compressive stress one can tolerate will depend on the adhesion of the layer being deposited to the previous belt. If an anodically produced nickel oxide is employed to enable the production of independent belts, the maximum internal compressive stress one can tolerate can be about 15,000 psi.

For example, if one wishes to make a belt assembly with a diameter of about eight inches comprised of several belts such that each belt has an inside diameter which is 0.0008 inches larger than the outside diameter of the previous belt, the internal stress is maintained at about 2,800 psi more compressive in each successive belt. Appropriate adjustments can be made in the calculation to compensate for the increased diameters of each belt. If a large number of belts is to be formed into a single belt assembly, it may be useful to use several mandrels of increasing diameter so that the compressive stress of belts being formed on any single mandrel does not rise too high.

The control of many of the elements of the electroforming bath, including the concentration of the impurities, and the operating parameters can be achieved by methods known in the art. For example, control of the pH by means of buffering agents, and preferred parameters for electrical current, time, and cell geometry are within the knowledge of those skilled in the electroforming art, and may have negligible impact on the incorporation of compressive stress in the electroformed belt. Other more critical components are discussed and exemplified below.

The temperature of the electroforming bath can be adjusted to control compressive stresses. For example, a series of belts each successively larger than the previously formed belt (i.e., formed with greater compressive stress) can be formed by adjusting the temperature at which each layer is electroformed. Increased temperature increases the mobility of the constituents in an electrolyte and decreases the thickness of the diffusion layers. Thus, the ability of many constituents to reach the cathode is facilitated. A successive increase in temperature of the bath of as little as 0.5° F. may result in a significant difference in compressive stress of each belt successively formed; thus, for belt assemblies of 40 belts or more, the temperature may be adjusted over a range of about 50° F.

The internal stress of a metal deposit such as nickel can be influenced by electrolyte addition agents such as sodium benzosulfimide dihydrate (saccharin) and 2-methyl benzene sulfonamide (MBSA) tensile stress reducers as well as many other chemicals which are in the electrolyte as impurities (e.g., zinc, tin, lead, cobalt, iron, manganese, magnesium, etc.) or in the electrolyte because of the breakdown of one or more of the constituents. Azodisulfonate, sulfite, and ammonium are examples of the latter. Some electrolyte constituents, whether they are added (e.g., boric acid), are impurities (e.g., sodium, copper), or are breakdown products (sulfate), have little or no direct impact on the internal stress of the deposit at concentrations which are near those normally found in working electrolyte baths. Azodisulfonate, a relatively short lived anodic oxidation product of sulfamate, will cause a deposit to be compressively stressed. If the deposit obtained from a system has a lower compressive stress after long periods of shut down (e.g., over a weekend), than obtained after some use, then azodisulfonate is suspected. More anode depolarizer or a higher anode to cathode ratio should be considered. Stress reducers may vary in concentration from 0 to about 2 g/L.

However, in a concentration of more than about 2 g/L, stress reducers can cause a powder to form rather than a metal deposit on core mandrels. At concentrations of about 1 g/L, a deposited nickel belt will often become so compressively stressed that the stress will be relieved during deposition, causing the deposit to be permanently wrinkled. Consequently, one cannot depend on adding large quantities of saccharin or other stress reducers to an electroforming bath to produce the desired compressive stresses and parting gap. Additionally, saccharin increases brittleness of the deposit.

Because of the significant effects of both temperature and solution composition on the final product, it is very desirable to maintain the electroforming solution in a constant state of agitation, thereby substantially precluding localized hot or cold spots, stratification and inhomogeneity in the composition. Moreover, constant agitation continuously exposes the mandrel to fresh solution and, in so doing, reduces the thickness of the cathode film, thus increasing the rate of diffusion through the film and thus enhancing metal deposition. Agitation may be maintained by continuous rotation of the mandrel and by impingement of the solution on the mandrel and cell walls as the solution is circulated through the system. Generally, the solution flow rate can range from 0 to about 75 L/minute across the mandrel surface and the rotation of the mandrel can range from about 1 rpm to about 2500 rpm. The combined effect of mandrel rotation and solution impingement assures uniformity of composition and temperature of the electroforming solution within the electroforming cell. An increase in the amount of agitation can produce increased compressive stress of the formed belt.

A series of belts with increasing compressive stress can also be formed by adjusting the current density. The current density may range from about 50 to about 650 ASF. Increasing the current density can increase the IR drop between the anode and cathode, which can cause the steady state temperature of the electrolyte to increase. The effect of temperature was discussed above. The temperature can also be controlled by adjusting other parameters appropriately. For example, the flow rate and/or the temperature of electrolyte to the cell could be adjusted to compensate for changes in IR. Electrolyte conductivity and/or specific heat could also be adjusted to keep the temperature constant while changing the current density. These adjustments can also impact the internal stress of the deposit.

For example, the amount of metal such as nickel deposited per unit time is directly proportional to the cathode efficiency and the current density. At 100% cathode efficiency, the thickness of the deposit obtained per unit time will double if the cathode current density is doubled. This means that the ratio of most stress causing constituents in the deposit to nickel in the deposit will change as the current density changes. Thus, changing current density will cause the stress in the deposit to change. This is particularly the case with constituents like sodium benzosulfimide dihydrate.

A series of belts may also be formed by adjusting both temperature and agitation.

For example, a first belt may be formed by the aforementioned electroforming process at an initial temperature of 130° C. and 20 rpm. A series of belts may then be formed as the temperature is stepwise and gradually increased to 160° C. and the rate of rotation of the mandrel is increased to 90 rpm. Each electroformed belt is removed from the mandrel after it is made. The belt is then assembled into a belt assembly after all belts are completed.

Using a low amount of agitation initially, at a low temperature, and slowly increasing the amount of agitation as well as slowly increasing the temperature of the electrolyte solution will result in a faster diffusion of the bath constituents, which can increase the resultant compressive stress within the endless metal belts. This is preferably accomplished by successively increasing both of these parameters during the formation of each belt, removing the belt, and then adjusting these parameters to be increased for the next belt.

In manipulating the bath chemistry and operating parameters as described herein, it is important to remember that the internal stress in the deposit will eventually reach a steady state condition which reflects the addition rate of the constituents causing the stress. For example, if one is operating a system at conditions which are using up a constituent which causes the deposit to be compressively stressed faster than that constituent is being added to the electrolyte, the deposits made in that system will become more and more tensilely stressed until the use rate matches the add rate. Therefore, one should start with an electrolyte which will produce a part with an internal stress at a level which is about half way between the minimum and maximum stresses sought. This will minimize the problems associated with keeping the electrolyte at the proper chemistry.

The electroforming process of this invention may be conducted in any suitable electroforming device. For example, a solid cylindrically shaped mandrel may be suspended vertically in an electroforming tank. The top edge of the mandrel may be masked off with a suitable, non-conductive material, such as wax, to prevent deposition. The mandrel may be of any suitable cross-section for the formation of an endless metal belt.

The electroforming tank is filled with the electroforming bath and the temperature of the bath is maintained at the desired temperature. The electroforming tank can contain an annular shaped anode basket which surrounds the mandrel and which is filled with metal chips. The anode basket is disposed in axial alignment with the mandrel. The mandrel is connected to a rotatable drive shaft driven by a motor. The drive shaft and motor are supported by suitable support members. Either the mandrel or the support for the electroforming tank may be vertically and horizontally movable to allow the mandrel to be moved into and out of the electroforming solution.

Electroforming current can be supplied to the tank from a suitable DC source. The positive end of the DC source can be connected to the anode basket and the negative end of the DC source connected to the drive shaft which supports and drives the mandrel. The electroforming current passes from the DC source connected to the anode basket, to the plating solution, the mandrel, the drive shaft, and back to the DC source.

In operation, the mandrel is lowered into the electroforming tank, and is preferably continuously rotated. As the mandrel rotates, a belt of electroformed metal is deposited on its outer surface. The electroformed belt is preferably thin, in order that many belts may be able to carry the load required, with each belt independently movable while superimposed in the "nest" of layers comprising the endless metal belt assembly. Each belt is preferably between 0.006 and 0.6 mm, more preferably 0.012 and 0.13 mm, thick, and most preferably 0.043 to 0.046 mm thick.

The compressive stress is adjusted such that upon removal from the mandrel, a gap of approximately 0.001 mm to 0.03 mm, preferably 0.01 mm, forms between the layers.

When the belt formed of deposited metal has reached the desired thickness and compressive stress, the belt may be removed from the mandrel. The bath chemistry is then adjusted by a change in one or more of the parameters described above. The process is repeated to form a subsequent belt, which is more compressively stressed than the previously formed belt. This process is repeated until the desired number of belts is formed. Each successive electroformed belt is superimposed on the previously formed belt. The number of belts formed may range from 2 to 40 or more.

When the electroforming of a belt is complete and the belt or belt assembly is to be removed from the mandrel, the mandrel is removed from the electroplating tank and immersed in a cold water bath. The temperature of the cold water bath is preferably between about 80° F. and about 33° F. When the mandrel is immersed in the cold water bath, the deposited metal belts are cooled prior to any significant cooling and contracting of the solid mandrel to impart an internal stress of between about 40,000 psi and about 80,000 psi to the deposited metal. If the metal is selected to have a stress-strain hysteresis of at least about 0.00015 in./in., it is permanently deformed, so that after the core mandrel is cooled and contracted, the deposited metal belt assembly may be removed from the mandrel. The belt assembly so formed does not adhere to the mandrel since the mandrel is formed from a passive material. Consequently, as the mandrel shrinks after permanent deformation of the deposited metal, the belt or belt assembly may be readily slipped off the mandrel. The belt must be bigger than the mandrel (assuming that the mandrel is not tapered) if one is going to remove the part from the outside of the mandrel. This can be facilitated by using a mandrel which is chiefly fabricated of a material which has a linear coefficient of thermal expansion which is larger or smaller than the linear coefficient of thermal expansion of the belt. An aluminum mandrel may meet these criteria when making a nickel belt. In cross section, (from inside out) such a mandrel may be 1 inch of aluminum, 0.001 inch of nickel, and 0.001 inch of chromium. Aluminum has a linear coefficient of thermal expansion of about $13\times10^{-6}$ in./in./°F. and nickel has a linear coefficient of thermal expansion of about $8\times10^{-6}$ in./in./°F. A mandrel which has a 20.690000 inch outside diameter at room temperature (70° F.) expands to 20.70883 at 140° F. If a nickel belt is deposited on this mandrel at 140° F. (typical operating temperature of the electrolyte), the nickel belt is then cooled to 40° F., the mandrel will have an outside diameter of 20.68190 and the nickel belt will have an inside diameter of 20.69226 (assuming that the internal stress is zero). The resulting parting gap will be 0.01036 inches. To separate a belt made on a mandrel with a linear coefficient of thermal expansion which is less than that of the belt, the belt and the mandrel are heated to obtain a parting gap.

This relationship can be expressed in the following manner:

$$PARTING\ GAP=\Delta T(\alpha_M-\alpha_d)D$$

wherein $\Delta T$ is the difference between the parting temperature and the deposition temperature, $\alpha_M$ is the linear coefficient of thermal expansion of the mandrel, $\alpha_d$ is the linear coefficient of thermal expansion of the deposit, and D is the outside diameter of the mandrel at the deposition temperature.

When the belt is removed from the mandrel, a residual compressive stress remains within the belt material. This residual compressive stress provides the belt with an improved capacity within the belt to handle the tensile stresses which occur at the pulleys during the operation of the belt in a continuously-variable transmission.

The belts so formed may have their edges strengthened by making the ductility of their edge regions greater than that of their center regions, for instance by annealing the edges, as disclosed in detail in application Ser. No. 07/633,027 filed simultaneously herewith and entitled "Endless Metal Belt With Strengthened Edges," which is hereby incorporated by reference.

This invention will further be illustrated in the following non-limiting examples, it being understood that these examples are intended to be illustrative only and that the invention is not intended to be limited to the materials, conditions, process parameters and the like recited therein.

EXAMPLE 1

An electroforming bath formed of the following electrolyte constituents and impurities, and operated in accordance with the following parameters will produce an electroformed nickel belt having the compressive stress shown in the FIGURE for varying saccharin concentrations and temperatures.

MAJOR ELECTROLYTE CONSTITUENTS:
Nickel sulfamate - as $Ni^{+2}$, 11.5 oz/gal. (86.25 g/L).
Chloride - as $NiCl_2.6H_2O$, 2.5 oz/gal. (18.75 g/L).
Boric Acid - 5.0–5.4 oz/gal. (37.5–40.5 g/L).
pH - 3.95–4.05 at 23° C.
Surface Tension- at 136° F., 32–37 d/cm using sodium lauryl sulfate (about 0.00525 g/L).
Saccharin - 15–60 mg/L, as sodium benzosulfimide dihydrate
IMPURITIES:
Azodisulfonate - 5–10 mg/L.
Copper - 5 mg/L.
Iron - 25 mg/L.
MBSA - (2-methyl benzene sulfonamide) - 5–10 mg/L.
Sodium - 0.1 gm/L.
Sulfate - 0.5 g/L.
OPERATING PARAMETERS:
Agitation rate - 5 Linear ft/sec solution flow over the cathode surface.
Cathode (mandrel) - current density, 225 ASF (amps per square foot).
Ramp rise - 0 to operating amps in 60 sec. ±5 sec.
Anode - sulfur depolarized nickel.
Anode to cathode ratio - 1.5:1.
Mandrel - chromium plated aluminum.

EXAMPLE 2

Process of electroforming belts which have diameters larger than the mandrel or the previous belt by adjusting temperature.

MAJOR ELECTROLYTE CONSTITUENTS:
Nickel sulfamate - as $Ni^{+2}$, 11.5 oz/gal. (86.25 g/L).
Chloride - as $NiCl_2.6H_2O$, 2.5 oz/gal. (18.75 g/L).
Boric acid - 5.0–5.4 oz/gal. (37.5–40.5 g/L).
pH - 3.95–4.05 at 23° C.
Surface tension - at 136° F., 32–37 d/cm using sodium lauryl sulfate (about 0.00525 g/L).
Saccharin - 30 mg/L, as sodium benzosulfimide dihydrate.
IMPURITIES:
Azodisulfonate - 5–10 mg/L.
Copper - 5 mg/L.
Iron - 25 mg/L.

MBSA - (2-methyl benzene sulfonamide) - 5–10 mg/L.
Sodium - 0.1 gm/L.
Sulfate - 0.5 g/L.
OPERATING PARAMETERS:
Agitation rate - 5 Linear ft/sec cathode rotation and 60 L/min solution flow to the 800 L cell.
Cathode (mandrel) - Current Density, 225 ASF (amps per square foot).
Ramp rise - 0 to operating amps in 60 sec. ±5 sec.
Anode - sulfur depolarized nickel.
Anode to cathode ratio - 1.5:1.
Mandrel - 20 inch diameter chromium plated aluminum.

When an electrolyte of this composition is prepared and operated at 135° F. in the electroforming system described by Wallin in U.S. Pat. No. 3,799,859, the resulting 0.003 inch thick deposit has an apparent internal stress of 5,500 psi compressive. If the temperature is increased to 145° F., the apparent internal stress will be 12,380 psi compressive. This difference in internal stress will be manifested as an increased belt diameter of about 0.0049 inches.

EXAMPLE 3

Process of electroforming belts which have diameters larger than the mandrel or the previous belt by adjusting current density.

MAJOR ELECTROLYTE CONSTITUENTS:
Nickel sulfamate - as $Ni^{+2}$, 11.5 oz/gal. (86.25 g/L).
Chloride - as $NiCl_2.6H_2O$, 2.5 oz/gal. (18.75 g/L).
Boric acid - 5.0–5.4 oz/gal. (37.5–40.5 g/L).
pH - 3.95–4.05 at 23° C.
Surface tension - at 136° F., 32–37 d/cm using sodium lauryl sulfate (about 0.00525 g/L).
Saccharin - 15 mg/L, as sodium benzosulfimide dihydrate.
IMPURITIES:
Azodisulfonate - 5–7 mg/L.
Copper - 5 mg/L.
Iron - 25 mg/L.
MBSA - (2-methyl benzene sulfonamide) - 5–8 mg/L.
Sodium - 0.1 gm/L.
Sulfate - 0.5 g/L.
OPERATING PARAMETERS:
Agitation rate - 5 Linear ft/sec cathode rotation and 15 L/min solution flow to the 200 L cell.
Cathode (mandrel) - Current density, 200–250 ASF (amps per square foot).
Ramp rise - 0 to operating amps in 60 sec. ±5 sec.
Plating temperature at equilibrium - 139°–141° F.
Anode - sulfur depolarized nickel.
Anode to cathode ratio - 1.5:1.
Mandrel - 8 inch diameter chromium plated aluminum.

No changes were made in electrolyte flow or temperature, conductivity or specific heat except those caused by the change in temperature which resulted from changing the current density. The equilibrium deposition temperature is 139° F. at 200 ASF, 140° F. at 225 ASF, and 141° F. at 250 ASF. This temperature increase will cause the belt produced at the higher temperature to have a diameter which was 0.0003 inches larger than the belt produced at the lower temperature.

Three 0.003 inch thick belts may be prepared using the system described in Example 2. The first belt is electroformed at 200 ASF, the next at 225 ASF, and the last at 250 ASF The difference between the inside diameter of the first belt and the inside diameter of the second belt is 0.0003 inches with the first belt electroformed at the lower current density being the larger. The difference between the inside diameter of the first belt and the inside diameter of the third belt is 0.0008 inches, again with the belt made at the lower current density being the larger.

EXAMPLE 4

Process of electroforming belts which have diameters larger than the mandrel or the previous belt by adjusting temperature and agitation.

MAJOR ELECTROLYTE CONSTITUENTS:
Nickel sulfamate - as $Ni^{+2}$, 11.5 oz/gal. (86.25 g/L).
Chloride - as $NiCl_2.6H_2O$, 2.5 oz/gal. (18.75 g/L).
Boric acid - 5.0–5.4 oz/gal. (37.5–40.5 g/L).
pH - 3.95–4.05 at 23° C.
Surface tension - at 136° F., 32–37 d/cm using sodium lauryl sulfate (about 0.00525 g/L).
Saccharin - 15 mg/L, as sodium benzosulfimide dihydrate.
IMPURITIES:
Azodisulfonate - 6–7 mg/L.
Copper - 5 mg/L.
Iron - 25 mg/L.
MBSA - (2-methyl benzene sulfonamide) - 6–8 mg/L.
Sodium - 0.1 gm/L.
Sulfate - 0.5 g/L.
OPERATING PARAMETERS:
Agitation rate - 5 Linear ft/sec cathode rotation and 15–20 L/min solution flow to the 200 L cell.
Cathode (mandrel) - Current density, 225 ASF (amps per square foot).
Ramp rise - 0 to operating amps in 60 sec. ±5 sec.
Plating temperature at equilibrium - 135°–145° F.
Anode - sulfur depolarized nickel.
Anode to cathode ratio - 1.5:1.
Mandrel - 8 inch diameter chromium plated aluminum.

Three 0.003 inch thick belts are made at 135° F. with the solution flow at 15, 17.5 and 20 L/min. The plating temperature at equilibrium is kept at 135° F. by adjusting the temperature of the electrolyte flowing to the cell. The internal stress of the belts is found to be 7,000 psi compressive at 15 L/min, 7,550 psi at 17.5 L/min and 7,800 psi at 20 L/min. Two more 0.0003 inch thick belts are made at 145° F., one at 15 L/min and the other at 20 L/min. The internal stress of the belts is found to be 10,000 psi compressive at 15 L/min, and 11,000 psi at 20 L/min.

Other modifications of the present invention may occur to those skilled in the art subsequent to a review of the present application, and these modifications, including equivalents thereof, are intended to be included within the scope of the present invention.

What is claimed is:

1. An electroforming process comprising:
electroforming a first belt on a mandrel, said first belt having a first compressive stress value;
electroforming a second belt on said mandrel under such conditions that said second belt has a second compressive stress value greater than said first compressive stress value; and
assembling said belts in a nest.

2. The process according to claim 1, wherein at least three electroformed belts are formed, and
wherein each successive belt has a greater compressive stress value.

3. The process according to claim 2, wherein all belts remain on the mandrel until the last belt is formed.

4. The process according to claim 2, wherein each belt is removed from the mandrel before the next belt is electroformed.

5. The process according to claim 1, wherein at least one operating parameter selected from the group consisting of electroforming bath temperature, current density, agitation, and stress reducer concentration is adjusted to form the second belt more compressively stressed than the first belt.

6. The process according to claim 5, wherein the stress reducer concentration is adjusted.

7. The process according to claim 5, wherein the temperature is adjusted.

8. The process according to claim 5, wherein the flow rate of the bath past the mandrel is adjusted.

9. The process according to claim 5, wherein the rate of rotation of the material is adjusted.

10. The process according to claim 5, wherein the agitation is adjusted by changing both the flow rate of the bath past the mandrel and the rate of rotation of the mandrel.

11. The process according to claim 5, wherein the current density is adjusted.

12. The process according to claim 5, wherein both the temperature and agitation are adjusted.

13. The process according to claim 2, wherein the compressive stress of each successive belt is increased by about 300 to about 5000 psi.

14. The process according to claim 2, wherein all said belts are electroformed in a single electroforming vessel.

15. The process according to claim 2, wherein each said belt is electroformed in a different electroforming vessel.

16. An endless metal belt assembly formed by a process comprising:

electroforming a first belt on said mandrel, said first belt having a first compressive stress value;

electroforming a second belt on said mandrel under such conditions that said second belt has a second compressive stress value greater than said first compressive stress value; and assembling said belts in a nest.

17. The belt assembly according to claim 16, wherein at least three electroformed belts are formed, and wherein each successive belt has a greater compressive stress value.

18. The belt assembly according to claim 17, wherein all belts remain on the mandrel until the last belt is formed.

19. The belt assembly according to claim 17, wherein each belt is removed from the mandrel before the next belt is electroformed.

20. The belt assembly according to claim 16, wherein at least one operating parameter of the electroforming bath selected from the group consisting of the temperature, current density, and agitation of the electrolyte solution is adjusted to form a second belt more compressively stressed than said first belt.

21. The belt assembly according to claim 20, wherein the stress reducer concentration is adjusted.

22. The belt assembly according to claim 20, wherein the temperature is adjusted.

23. The belt assembly according to claim 20, wherein the flow rate of the bath past the mandrel is adjusted.

24. The belt assembly according to claim 20, wherein the rate of rotation of the mandrel is adjusted.

25. The belt assembly according to claim 20, wherein the agitation is adjusted by changing both the flow rate of the bath past the mandrel and the rate of rotation of the mandrel.

26. The belt assembly according to claim 20, wherein the current density is adjusted.

27. The belt assembly according to claim 20, wherein both the temperature and agitation are adjusted.

28. The belt assembly according to claim 17, wherein compressive stress of each successive belt is increased by about 300 to about 5000 psi.

29. A process for making a nested belt assembly, comprising electroforming a series of belts for said assembly such that a radial clearance between each pair of adjacent belts is substantially equal to a minimum clearance required for lubrication.

30. An endless metal belt assembly, comprising a series of nested belts, wherein a radial clearance between each pair of adjacent belts is substantially equal to a minimum clearance required for lubrication.

* * * * *